US011663973B1

(12) United States Patent
Tan et al.

(10) Patent No.: US 11,663,973 B1
(45) Date of Patent: May 30, 2023

(54) EXTERNAL COMPENSATION FOR DISPLAYS USING SENSING AND EMISSION DIFFERENCES

(71) Applicant: Apple Inc., Cupertino, CA (US)

(72) Inventors: Junhua Tan, Saratoga, CA (US); Shengkui Gao, San Jose, CA (US); Myungjoon Choi, Sunnyvale, CA (US); Injae Hwang, Cupertino, CA (US); Chaohao Wang, Sunnyvale, CA (US); Myung-Je Cho, San Jose, CA (US); Hyunwoo Nho, Palo Alto, CA (US); Sun-Il Chang, San Jose, CA (US); Jesse A. Richmond, San Francisco, CA (US); Kingsuk Brahma, Mountain View, CA (US); Jie Won Ryu, Santa Clara, CA (US); Shiping Shen, Cupertino, CA (US); Yunhui Hou, San Jose, CA (US)

(73) Assignee: Apple Inc., Cupertino, CA (US)

( * ) Notice: Subject to any disclaimer, the term of this patent is extended or adjusted under 35 U.S.C. 154(b) by 72 days.

(21) Appl. No.: 16/409,583

(22) Filed: May 10, 2019

Related U.S. Application Data

(60) Provisional application No. 62/669,898, filed on May 10, 2018.

(51) Int. Cl.

| | |
|---|---|
| ***G09G 3/3258*** | (2016.01) |
| ***G09G 3/32*** | (2016.01) |
| ***G09G 3/3233*** | (2016.01) |

(52) U.S. Cl.
CPC ..... *G09G 3/3258* (2013.01); *G09G 3/32* (2013.01); *G09G 3/3233* (2013.01); *G09G 2320/0233* (2013.01); *G09G 2320/0646* (2013.01); *G09G 2320/0693* (2013.01); *G09G 2330/08* (2013.01); *G09G 2330/12* (2013.01)

(58) Field of Classification Search
CPC ..... G09G 3/3258; G09G 3/32; G09G 3/3233; G09G 2320/0233; G09G 2320/0646; G09G 2320/0693; G09G 2330/08; G09G 2330/12
See application file for complete search history.

(56) References Cited

U.S. PATENT DOCUMENTS

2015/0077315 A1* 3/2015 Chaji ..... G09G 1/12 345/76
2017/0018219 A1* 1/2017 Wang ..... G09G 3/2092
2017/0365205 A1* 12/2017 Kishi ..... G01R 19/10

* cited by examiner

*Primary Examiner* — Wing H Chow
(74) *Attorney, Agent, or Firm* — Fletcher Yoder, P.C.

(57) ABSTRACT

External compensation of display panels may employ measurement or sensing circuitry configured to measure the output of a pixel and compensate for variations. Due to effects from the sensing circuitry, a mismatch between a target current and the actual current in the pixel may occur. Systems and methods that compensate for the effects from sensing circuitry and reduce or mitigate the mismatch are described. Systems and methods described herein include compensation circuitry that is capable of employing correction factors to compensate for the effects due to the presence of sensing circuitry. Methods for determining the correction factor are also described.

20 Claims, 10 Drawing Sheets

EXTERNAL COMPENSATION FOR DISPLAYS USING SENSING AND EMISSION DIFFERENCES

CROSS-REFERENCE TO RELATED APPLICATION

This application claims priority from and the benefit of U.S. Provisional Application Ser. No. 62/669,898, entitled "EXTERNAL COMPENSATION FOR DISPLAYS USING SENSING AND EMISSION DIFFERENCES," filed May 10, 2018, which is hereby incorporated by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Pixel-based display panels may generate images by the use of driving signals (e.g., a voltage or a current) provided to the individual pixels of the display. Due to inhomogeneities across pixels of a display, the brightness level of the pixel in response to a specific electrical signal may vary. Compensation circuitry that receives data from sensing circuitry may be used to correct the driving signals and prevent image artifacts from appearing. However, coupling the sensing circuitry to a pixel may change the electrical characteristics of the pixel circuitry. To prevent the changes caused by the presence of the sensing circuitry, such differences may be calibrated and correction factors may be programmed into the compensation circuitry of the display. Embodiments described herein include systems and methods that are capable of performing such calibrations and employing the correction factors during compensation using measurements from the sensing circuitry. The use of the embodiments described herein may improve the quality of the images provided by the display.

In one embodiment, an electronic device is described. The electronic device may include a pixel panel having multiple pixels, sensing circuitry that can be coupled or decoupled to the pixels, and compensation circuitry that may process image signals for the pixel. Processing of the image signals may use data including a received image signal from processing circuitry of the electronic device and received measurements from the sensing circuitry. The compensation circuitry may also employ a correction factor formula that may use the received image signal, the received measurements, and correction factor that is calculated to compensate an effect of the measurement circuitry on the pixels. Using the received data, as well as a correction factor, the compensation circuitry may generate a compensated signal, which may be provided to the pixel.

In another embodiment, a method for calibration is described. The method may include a determination of a current-voltage characteristic for pixels of the pixel panel in a condition in which the sensing circuitry is not coupled to the pixels or does not affect the pixel. The method may also include a determination of a current-voltage characteristics for pixels of the pixel panel in a condition in which the measurement circuitry is coupled to the pixels. Based on the two current-voltage characteristics calculated, a correction factor may be determined. The correction factor may be stored in a compensation circuitry of the pixel panel and may be used as part of a formula for compensation of signals.

In another embodiment, a method for compensating brightness in a pixel panel is described. The method may include a process for receiving a driving signal from processing circuitry, which is expected to generate a target current in the pixel, which may be associated with a target brightness for the pixel. The method may also include a process for receiving a measurement of an actual current generated in the pixel in response to the electric signal. The method may also include a process for generation of a compensated signal, which takes into account a difference between the target and the actual current in the pixel as well as a correction factor that may be stored in the compensation circuitry.

The correction factor is calculated to compensate for the impact of the measurement circuitry. The compensated signal may be provided to the pixel.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
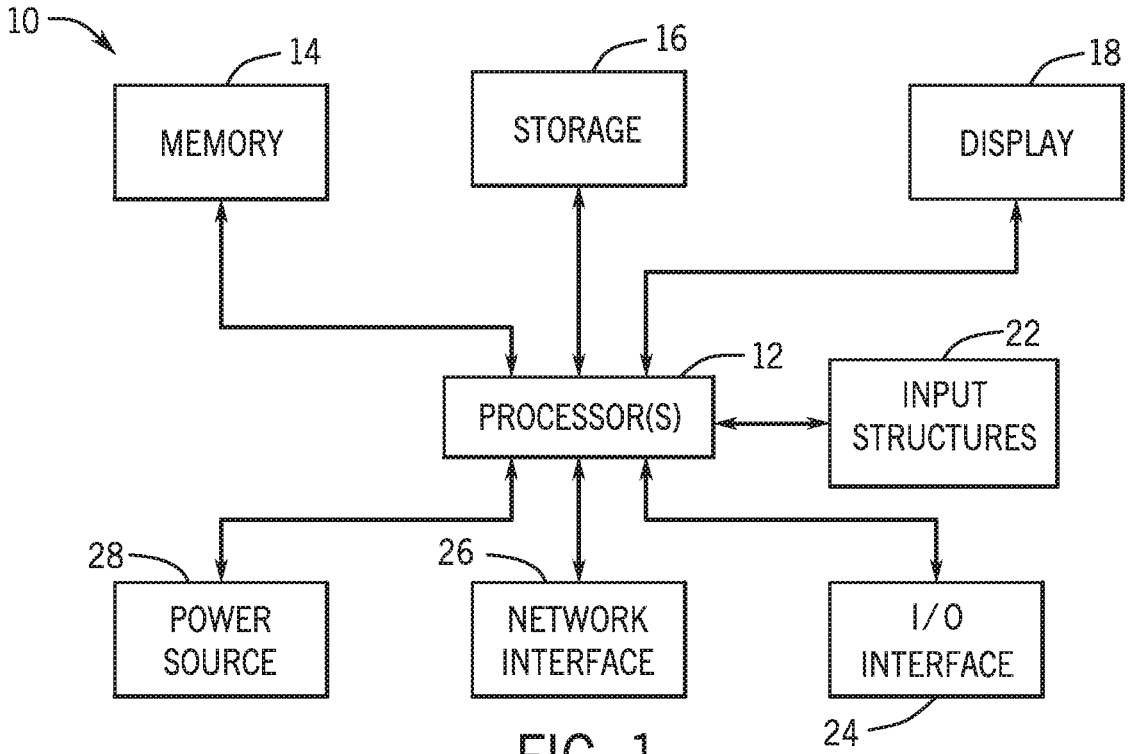
FIG. 1 is a schematic block diagram of an electronic device that may implement the external compensation in pixel-based displays, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Many electronic devices may use display panels to display images or provide user interfaces. The displays may be line-based displays, such as cathode-ray tube (CRT) displays, or pixel-based displays, such as light-emitting diode (LED) displays, organic LED (OLED) displays, active-matrix OLED (AMOLED) displays, electronic-ink displays, electronic paper displays, among others. Pixel-based displays may operate by means of driving circuitry (or circuitries) that provides an electrical signal (e.g., a current or a voltage) to each pixel. In response to the electric signal, each the pixel circuitry may provide a specific level of brightness or color. For example, in LED displays, each pixel circuitry may receive a voltage corresponding to a target brightness and may drive a current through the LED. In this example, the brightness of the pixel may be associated to the current passing through the LED.

Many electronic devices, such as televisions, smartphones, computer panels, smartwatches, and automobile dashboards, among others, include electronic displays that can display content and provide user interfaces. The electronic displays may employ pixel panels, which may be operatively coupled to image generation circuitry in the electronic device. The electronic display may receive image data from image generation circuitry or processing circuitry, and generate driving signals to the individual pixels in the pixel panel. As an example, in panels using pixels formed from light-emitting diodes (LEDs) or organic light-emitting diodes (OLEDs), pixel-driving circuitry in the display may receive image data and may set a target pixel brightness for each pixel and form the image, by providing a voltage signal to the individual pixels. The current induced through the LED or OLED through in response to the voltage signal may cause the target brightness.

Due to variations that may occur by, for example, fabrication artifacts, component age, temperature, humidity variations, or material variations, different pixels may respond differently to the driving signals. For example, in an OLED-based pixel panel, different OLED pixels circuits may induce different currents in response to a given input voltage. To correct such errors, pixel circuitry may be coupled to sensing circuitry, and the data generated by the sensing circuitry may be used to adjust the input voltage. The use of compensation circuitry may improve the quality of images and prevent artifacts in the display panel due to the pixel inhomogeneities through the display.

As an example of inhomogeneities in a display, consider an OLED-based panel in which each pixel is driven using a voltage signal received from the driver. A transistor associated with the pixel may receive the voltage signal and may drive a current through the OLED of the pixel. The brightness of the OLED pixel may be proportional to the source current ($I_S$), which may be determined, among other things, by the gate-source voltage ($V_{GS}$) of the transistor and the impedance displayed by the OLED. The relationship between the $V_{GS}$ and the Is (i.e., the IV characteristic of the pixel circuitry) may be different across the display panel due to differences among the transistors or the OLEDs.

In order to prevent variations in the IV characteristic from causing visual artifacts in the display panel, compensation systems may be used. Compensation systems may include sensing circuitry that can measure the actual source current $I_S$ obtained in response to the input electrical signal, and compensation circuitry may be use the measured Is to adjust the input electrical signal based on the measurements. However, the IV characteristic of the pixel circuitry during sensing may be different from the IV characteristic of the pixel circuitry under normal conditions (i.e., not sensing). This may be caused, for example, by impact of the coupling to the sensing circuitry, as detailed below. This effect may impact the quality of the compensation system in the display panel. The embodiments of the present application detailed below include methods and systems that take into account the impact of the sensing circuitry to perform a calibration and generate a correction factor for compensation systems. As detailed below are method and system embodiments that employ the calibrated correction factor to improve the image quality of the display.

With the foregoing in mind, a general description of suitable electronic devices with reduced bezel dimensions that may compensation circuitry for pixels, as discussed herein, are provided below. Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, a network interface 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of an implementation and is intended to illustrate the types of components that may be present in electronic device 10.

Figure 2:
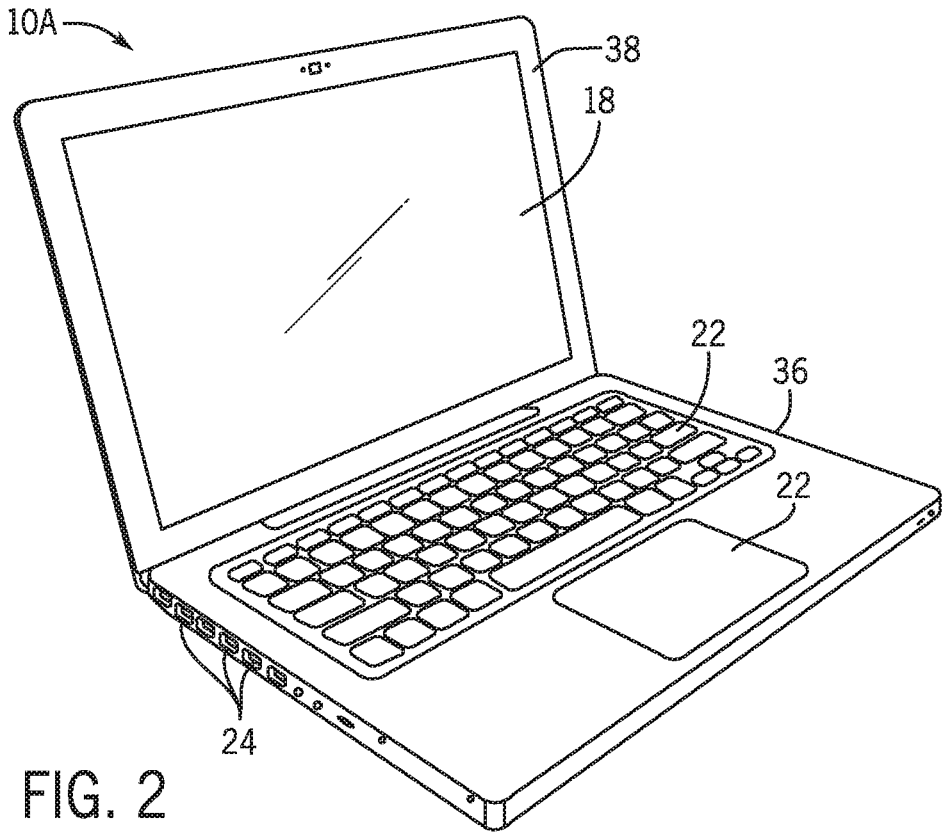
FIG. 2 is a perspective view of a notebook computer representing an embodiment of the electronic device of FIG. 1, in accordance with an embodiment.
Figure 4:
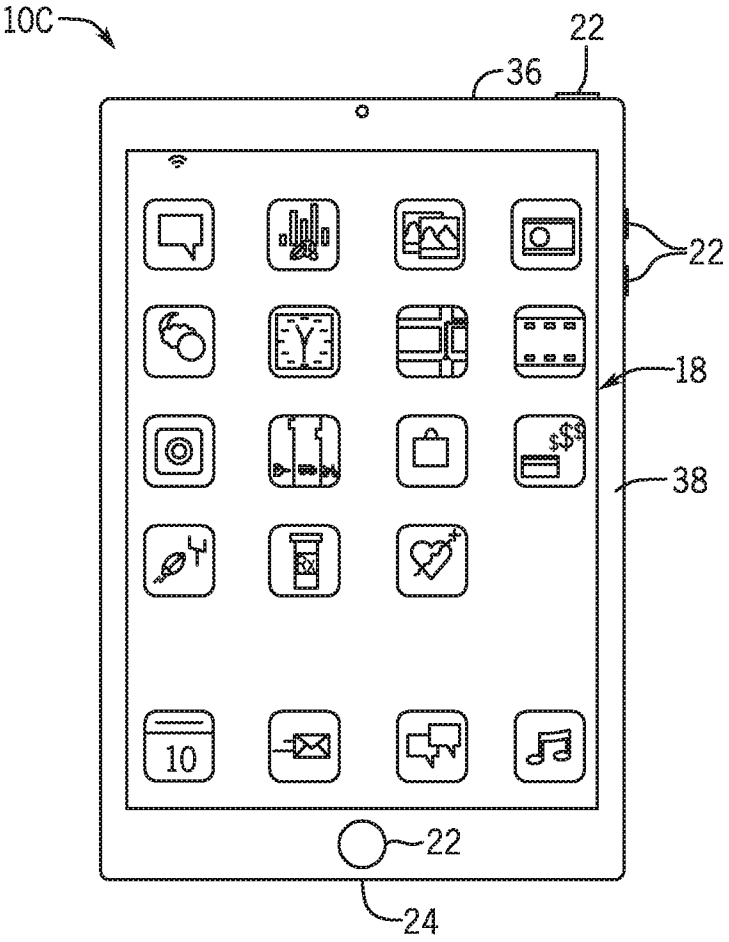
FIG. 4 is a front view of another hand-held device representing another embodiment of the electronic device of FIG. 1, in accordance with an embodiment.
Figure 3:
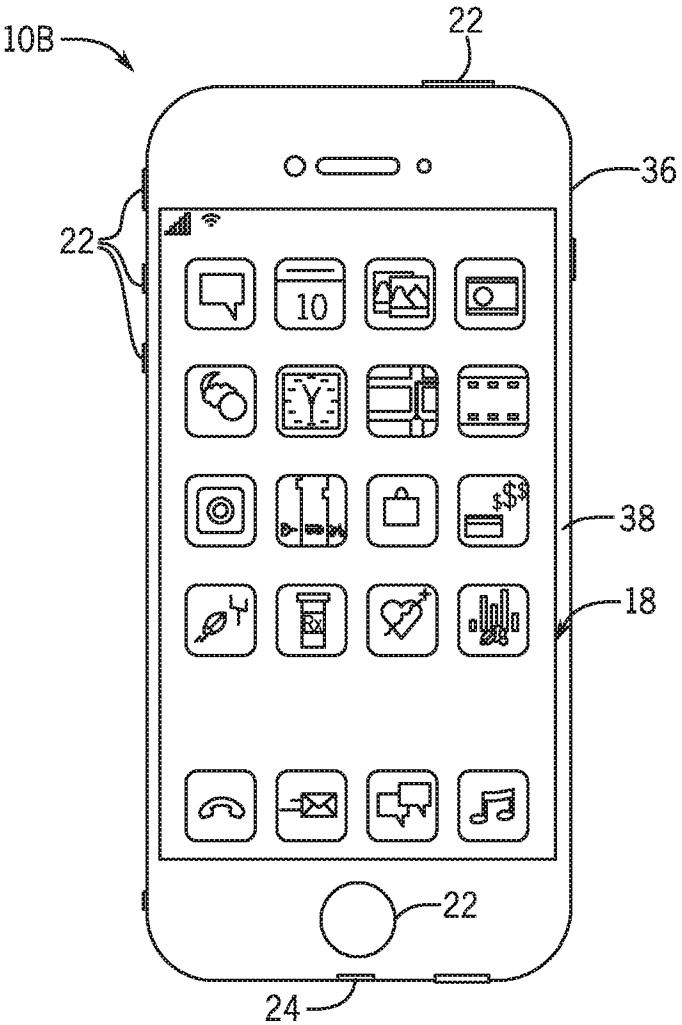
FIG. 3 is a front view of a hand-held device representing another embodiment of the electronic device of FIG. 1, in accordance with an embodiment.
Figure 5:
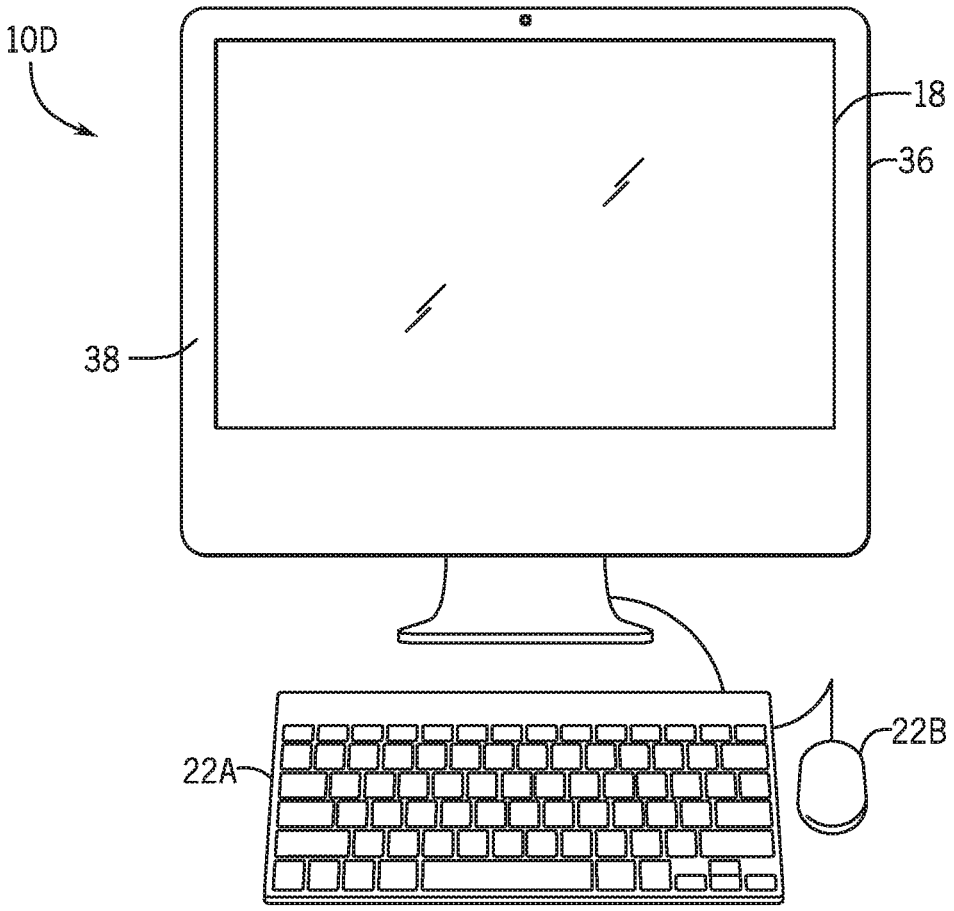
FIG. 5 is a front view of a desktop computer representing another embodiment of the electronic device of FIG. 1, in accordance with an embodiment.
Figure 6:
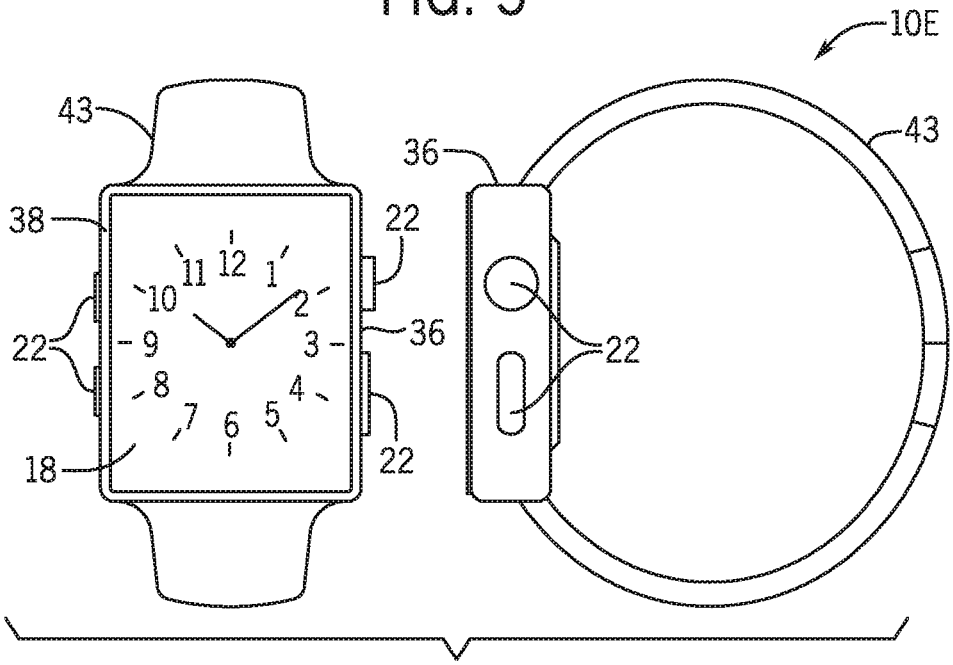
FIG. 6 is a front view and side view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 may be operably coupled with the memory 14 and the nonvolatile storage 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 12 to enable the electronic device 10 to provide various functionalities.

In certain embodiments, the display 18 may be a liquid-crystal display (LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, or some combination of LCD panels and OLED panels. The display 18 may receive images, data, or instructions from processor(s) 12 or memory 14, and provide an image in display 18 for interaction.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, one or more interfaces for a personal area network (PAN), such as a Bluetooth network, for a local area network (LAN) or wireless local area network (WLAN), such as an 802.11x Wi-Fi network, and/or for a wide area network (WAN), such as a 3rd generation (3G) cellular network, 4th generation (4G) cellular network, long term evolution (LTE) cellular network, or long term evolution license assisted access (LTE-LAA) cellular network. The network interface 26 may also include one or more interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-Wideband (UWB), alternating current (AC) power lines, and so forth. As further illustrated, the electronic device 10 may include a power source 28. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc.

By way of example, the electronic device 10, taking the form of a notebook computer 10A, is illustrated in FIG. 2 in accordance with one embodiment of the present disclosure. Notebook computer 10A, or laptop computer, may be a MacBook®, MacBook® Pro, MacBook Air® by Apple, Inc. The depicted computer 10A may include a housing or enclosure 36, a display 18 framed by a bezel 38 of the enclosure 36, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPhone® available from Apple Inc. of Cupertino, Calif. The handheld device 10B may include an enclosure 36 to protect interior components from physical damage and to shield them from electromagnetic interference. The enclosure 36 may include bezel 38, which surrounds the display 18. The I/O interfaces 24 may open through the enclosure 36 and may include, for example, an I/O port for a hard-wired connection for charging and/or content manipulation using a standard connector and protocol, such as the Lightning connector provided by Apple Inc., a universal service bus (USB), or other similar connector and protocol.

User input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, Calif. The handheld device 10C may include an enclosure 36 to protect interior components from physical damage and to shield them from electromagnetic interference. The enclosure 36 may include bezel 38, which surrounds the display 18. The I/O interfaces 24 may open through the enclosure 36 and may include, for example, an I/O port for a hard-wired connection for charging and/or content manipulation using a standard connector and protocol, such as the Lightning connector provided by Apple Inc., a universal service bus (USB), or other similar connector and protocol.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, or other similar device by Apple Inc. It should be noted that the computer 10D may also represent a personal computer (PC) by another manufacturer. A similar enclosure 36 may be provided to protect and enclose internal components of the computer 10D such as the display 18. The display 18 may be surrounded by a bezel 38 of the enclosure 36. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The display 18, framed by a bezel 38 of the enclosure 36 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
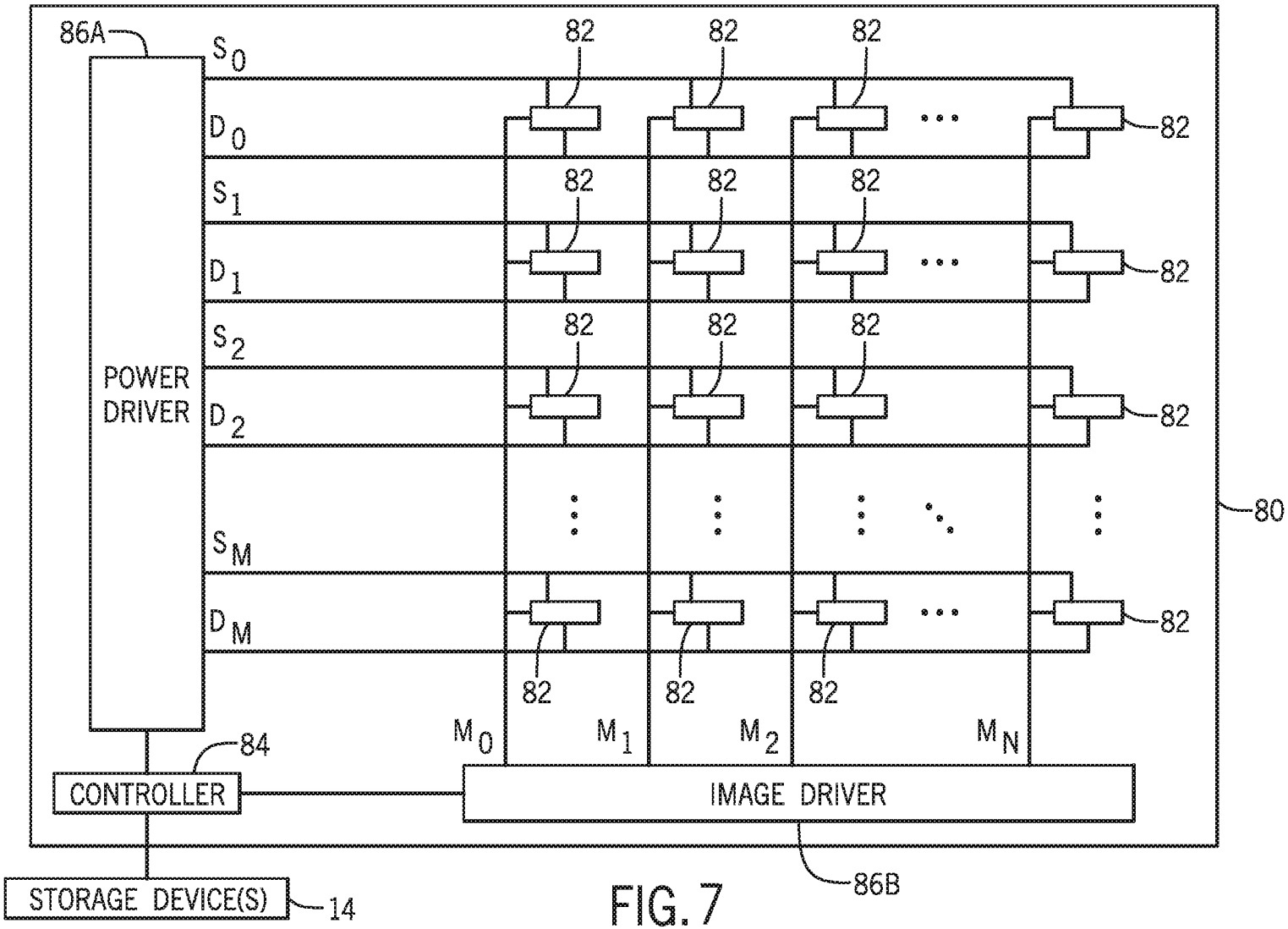
FIG. 7 is a circuit diagram of the pixel-based display of FIG. 1, in accordance with an embodiment.

As shown in FIG. 7, the display 18 may include a pixel array 80 having an array of one or more of pixels 82. The display 18 may include any suitable circuitry to drive the pixels 82. In the example of FIG. 7, the display 18 includes a controller 84, a power driver 86A, an image driver 86B, and the array of the pixel 82. The power driver 86A and image driver 86B may individually drive the pixels 82. In some embodiments, the power driver 86A and the image driver 86B may include multiple channels for independently driving multiple of the pixel 82. Each of the pixel 82 may include pixel circuitry, capable of receiving the electrical signals (e.g., driving signals from the power driver 86A or image driver 86B) and provide a current through a suitable light emitting element, such as a LED, one example of which is an OLED that causes light emission.

The scan lines S0, S1, . . . , and Sm and driving lines D0, D1, . . . , and Dm may connect the power driver 86A to the pixel 82. The pixel 82 may receive on or off instructions through the scan lines S0, S1, . . . , and Sm and may generate programming voltages corresponding to data voltages transmitted from the driving lines D0, D1, . . . , and Dm. The programming voltages may be transmitted to each of the pixel 82 and cause emission of light according to instructions from the image driver 86B through driving lines M0, M1, . . . , and Mn. Both the power driver 86A and the image driver 86B may transmit voltage signals at programmed voltages through respective driving lines to operate each pixel 82 at a state determined by the controller 84 to emit light. Each driver may supply voltage signals at a duty cycle or amplitude sufficient to operate each pixel 82.

The target brightness of each of the pixels 82 may be defined by the received image data. In this way, a first brightness of light may emit from a pixel 82 in response to a first value of the image data and the pixel 82 may emit a second brightness of light in response to a second value of the image data. Thus, image data may form images by generating driving signals to each individual pixel 82 that causes the individual pixels 82 to provide the target brightness.

The controller 84 may retrieve image data stored in the storage device(s) 14 indicative of the target brightness for the colored light outputs of individual pixels 82. In some embodiments, the processing circuit(s) 12 may provide image data directly to the controller 84. The controller 84 may coordinate the signals provided to each pixel 82 from the power driver 86A or image driver 86B. The pixel 82 may include pixel circuitry, which may include a controllable element, such as a transistor, one example of which is an MOSFET. The pixel circuitry may process the signals received from the power driver 86A or image driver 86B, and may generate the target brightness. However, any other suitable type of controllable elements, including thin film transistors (TFTs), p-type and or n-type MOSFETs, and other transistor types, may also be used.

Figure 8:
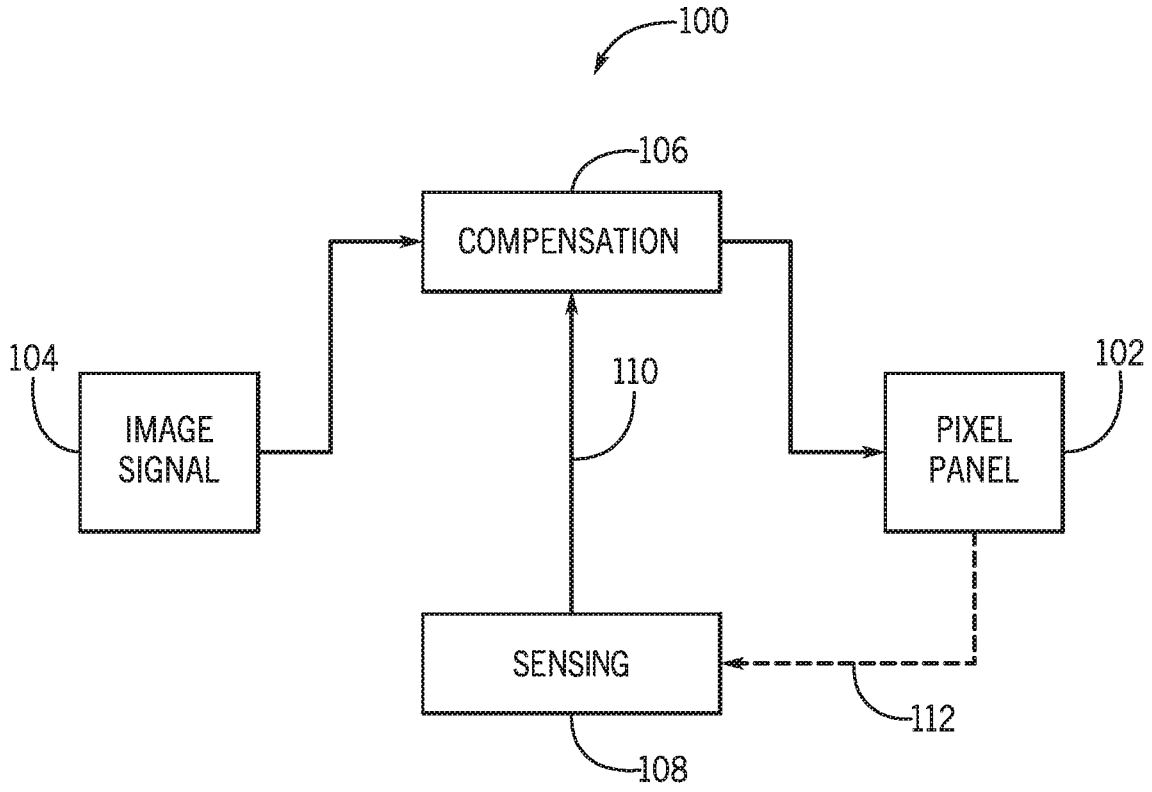
FIG. 8 is a diagram of pixel-driving circuitry that may employ external sensing-based compensation, in accordance with an embodiment.

The diagram in FIG. 8 illustrates a compensation system 100. The compensation system 100 may correct the driving signals provided to a pixel panel 102 from the driving circuitry 104. Driving circuitry 104, such as the power driver 86A or the image driver 68B described above, may generate signals directed to individual pixels. Signal from the driving circuitry 104 may go through compensation circuitry 106. The compensation circuitry 106 may process the driving signals from the driving circuitry 104 using measurement data 110 received from a sensing circuitry 108. The measurement data 110 may include a current or a voltage in one or more pixels of the pixel panel 102. Using the measurement data 110, the compensation circuitry 106 may adjust the driving signal received from the driving circuitry, and may generate a compensated signal to pixels of the pixel panel 102.

To perform the measurement and obtain the measurement data 110, sensing circuitry 108 may be coupled to the pixels of the pixel panel 102 through an electrical coupling 112. The electrical coupling 112 may be configurable (e.g., switchable), such that the sensing circuitry 108 is coupled to the pixel circuitry during sensing, and uncoupled from the pixel circuitry during normal operations. However, as discussed above and detailed below, the sensing circuitry 108 may, through the electrical coupling 112, impact the IV characteristic of the pixel circuitry in the pixel panel 102. To compensate for differences in the IV characteristics between sensing and normal conditions, the compensation circuitry 106 may employ a correction factor in the compensation of the driving signal, which is detailed below.

Figure 9:
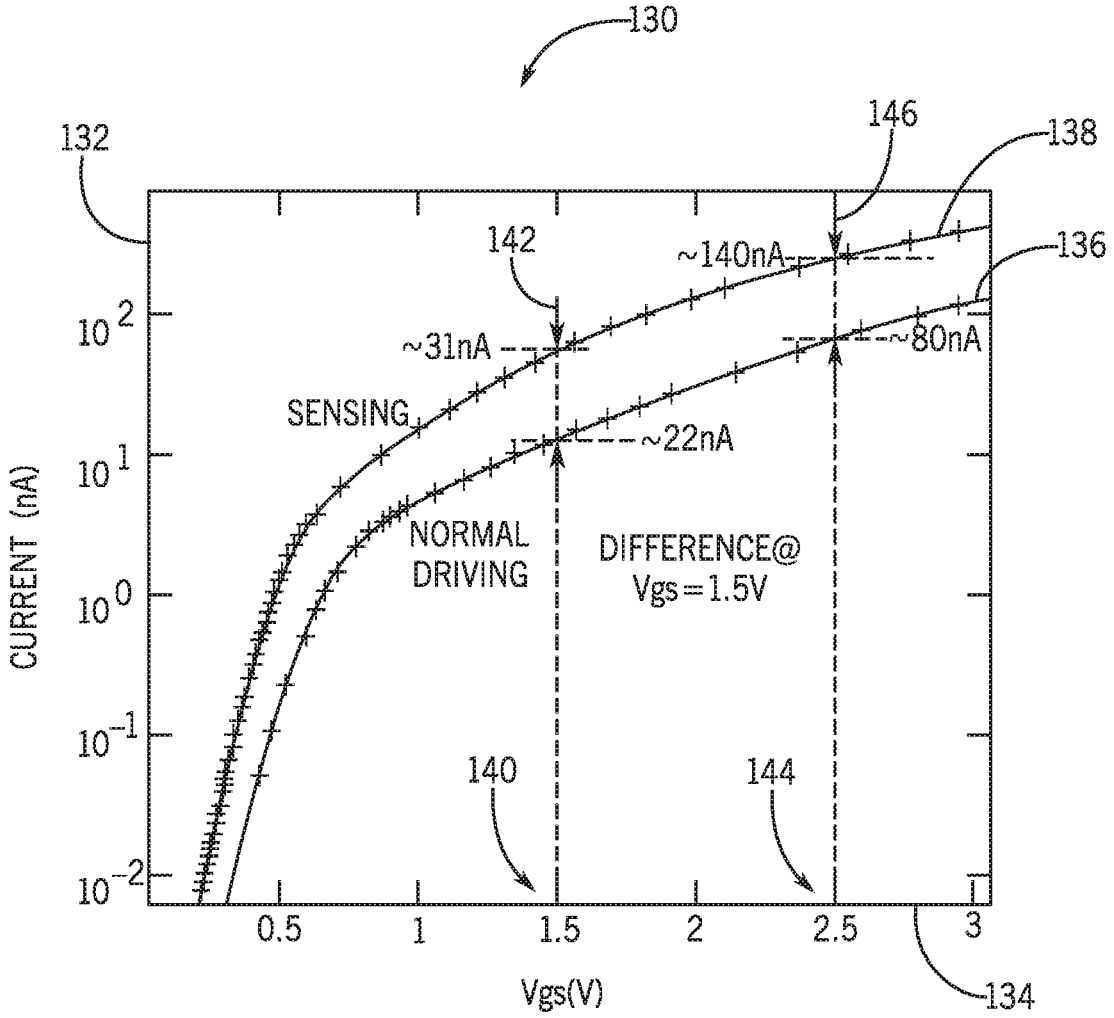
FIG. 9 is a chart illustrating, using an example, the impact of the sensing circuitry in the current-voltage (IV) diagram, in accordance with an embodiment.

The chart 130 in FIG. 9 illustrates the impact of the sensing circuitry 108 on the IV curves for pixel circuitry of a pixel which may be driven using a transistor. Chart 130 shows the source current $I_S$ 132 through the transistor as a function of the gate-source voltage $V_{GS}$ 134 for a pixel during normal conditions 136 (i.e., when it is not being measured and, thus, uncoupled from the sensing circuitry), and during sensing conditions 138 (i.e., when it is measured and, thus, coupled to the sensing circuitry). The source current $I_S$ 132 may be the current driven through the light-emitting element (e.g., LED).

As illustrated in chart 130, during sensing conditions 138, the IV characteristic may be shifted up relative to the normal conditions 136. For example, at a voltage of approximately 1.5V (voltage 140), the pixel current may be approximately 22 nA in normal conditions 136 and may be 31 nA in sensing conditions 138, resulting in a shift 142 of approximately 9 nA. As a result of the shift 142, a system employing data obtained during sensing may underestimate the required $V_{GS}$ 134 that produces a particular $I_S$ 132. Moreover, chart 130 illustrates that the difference is not uniform. As illustrated, at a voltage of approximately 2.5V (voltage 144), the pixel current may be approximately 80 nA in normal conditions 136, but may be 140 nA in sensing conditions 138, leading to a shift 146 at voltage 144 that is substantially different from the shift 142 at voltage 140. Therefore, the compensation strategy may benefit from employing a content-dependent (e.g., current-dependent, voltage dependent, brightness-dependent) correction factor.

Figure 10A:
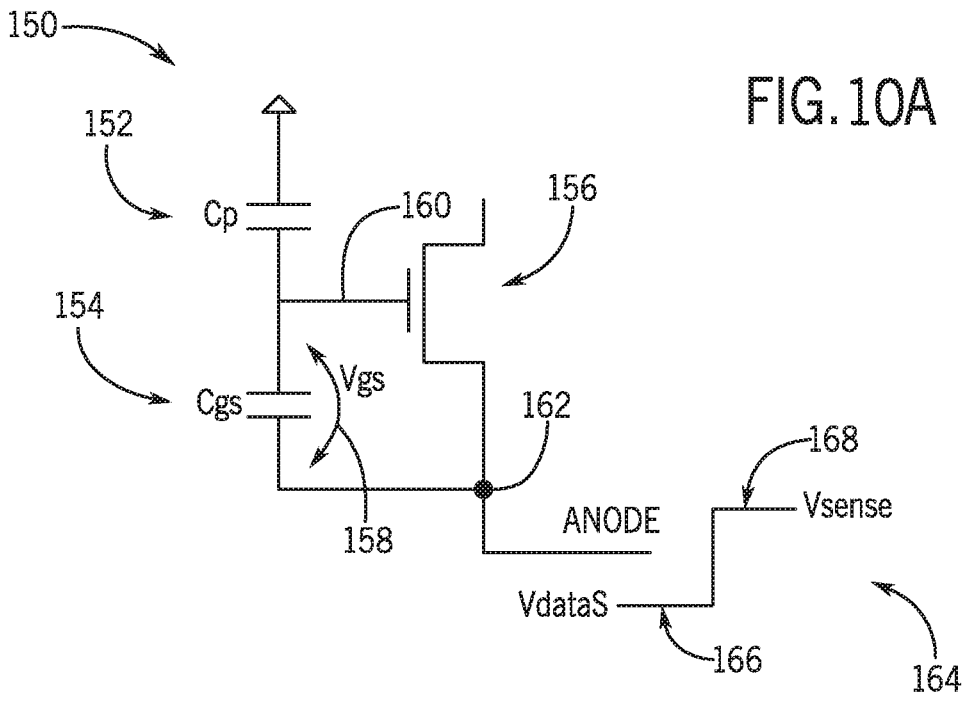
FIG. 10A is a diagram of pixel circuitry during sensing, in accordance with an embodiment.
Figure 10B:
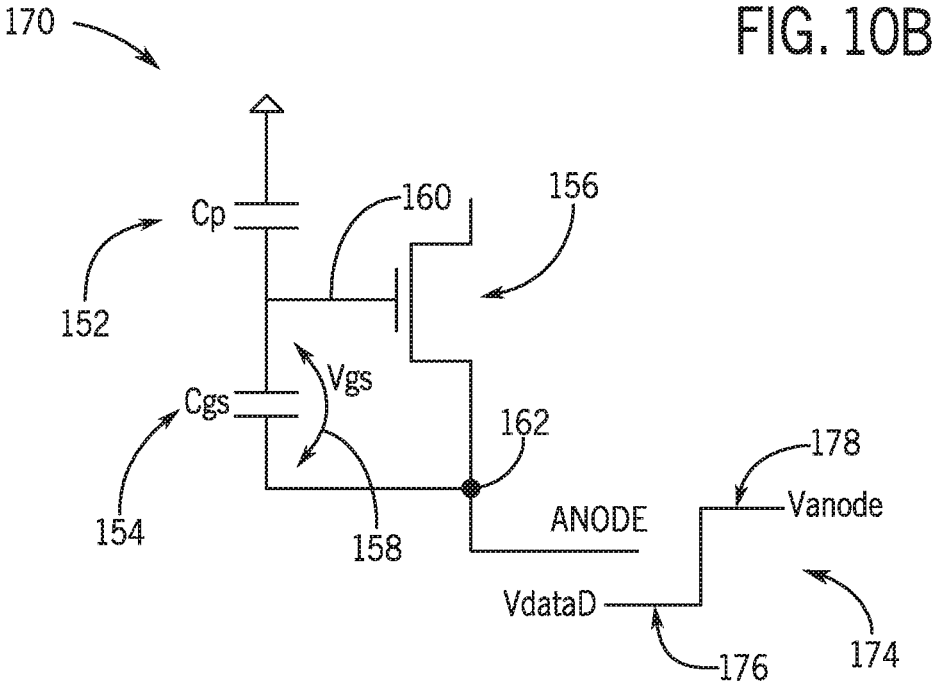
FIG. 10B is a diagram of the pixel circuitry of FIG. 10A during normal operation, in accordance with an embodiment.

One cause for the impact of the sensing circuitry in the measurements is illustrated in FIGS. 10A and 10B. The diagram in FIG. 10A illustrates the configuration of a pixel 150 during sensing conditions (e.g., sensing condition 138 of FIG. 9). In the arrangement, capacitors $C_P$ 152 and $C_{GS}$ 154 are configured to provide a charge from a reference signal to the transistor 156. The diagram also illustrates the $V_{GS}$ voltage between gate 160 and source 162 of the transistor 156. The circuit in diagram may be under sensing conditions, in which sensing circuitry is coupled to the pixel 150. As a result, the gap 164 between an input voltage $V_{dataS}$ 166, and an anode voltage $V_{sense}$ 168 may lead to the $V_{GS}$ 158. In fact, for pixel 150 in FIG. 10A, the $V_{GS}$ 158 may be described as:

$$V_{gs}=V_{ref}-V_{dataS}+k(V_{dataS}-V_{sense}). \tag{1}$$

In the above equation, as well as in the following descriptions, k is determined by the voltage divider expression:

$$k=\frac{C_p}{C_{gs}+C_p}. \tag{2}$$

The diagram in FIG. 10B illustrates the configuration of the pixel 150 during normal conditions (e.g., normal conditions 136 of FIG. 9). In such system, the pixel 150 is arranged in the same circuit as the one illustrated in FIG. 10A, but is under normal conditions, in which sensing circuitry is decoupled. As a result, the gap 174 between an input voltage $V_{dataD}$ 176, and the normal anode voltage $V_{anode}$ 178 may lead to a $V_{GS}$ 158.

As a result, the $V_{GS}$ 158 in pixel 150 in the FIG. 10B may be described as:

$$V_{gs}=V_{ref}-V_{dataD}+k(V_{dataD}-V_{anode}). \tag{3}$$

Note that the $V_{anode}$ 178 may be different from the $V_{sense}$ 168. As a result, if $V_{dataS}$ 166 and $V_{dataD}$ 176 are equal, the current $I_S$, and thus, the brightness may be different. In order to prevent the difference in brightness, and due to the fact that the $V_{GS}$ 158 may determine the brightness of the pixel, the $V_{GS}$ expressions (1) and (3) may be equated, to identify a calibration curve, or compensation curve. To that end, an expression for the input voltage under normal conditions, $V_{dataD}$ 176, as a function of $V_{dataS}$ 166 may be identified as:

$$V_{dataD}=V_{dataS}+\frac{k}{k+1}(V_{OLED}(I)+V_{SSEL}(DBV)-V_{sense}). \tag{4}$$

In the above expression, $V_{OLED}(I)$ corresponds to the correction applied in view of the current going through the OLED, and $V_{SSEL}(DBV)$ corresponds to a baseline or bias voltage that may be associated with the global display brightness level. The above expression allows calculation of the $V_{dataD}$ 176 that should be used under normal conditions to obtain a target brightness when the $V_{dataS}$ 166 is the voltage that provided that brightness during sensing.

Figure 11:
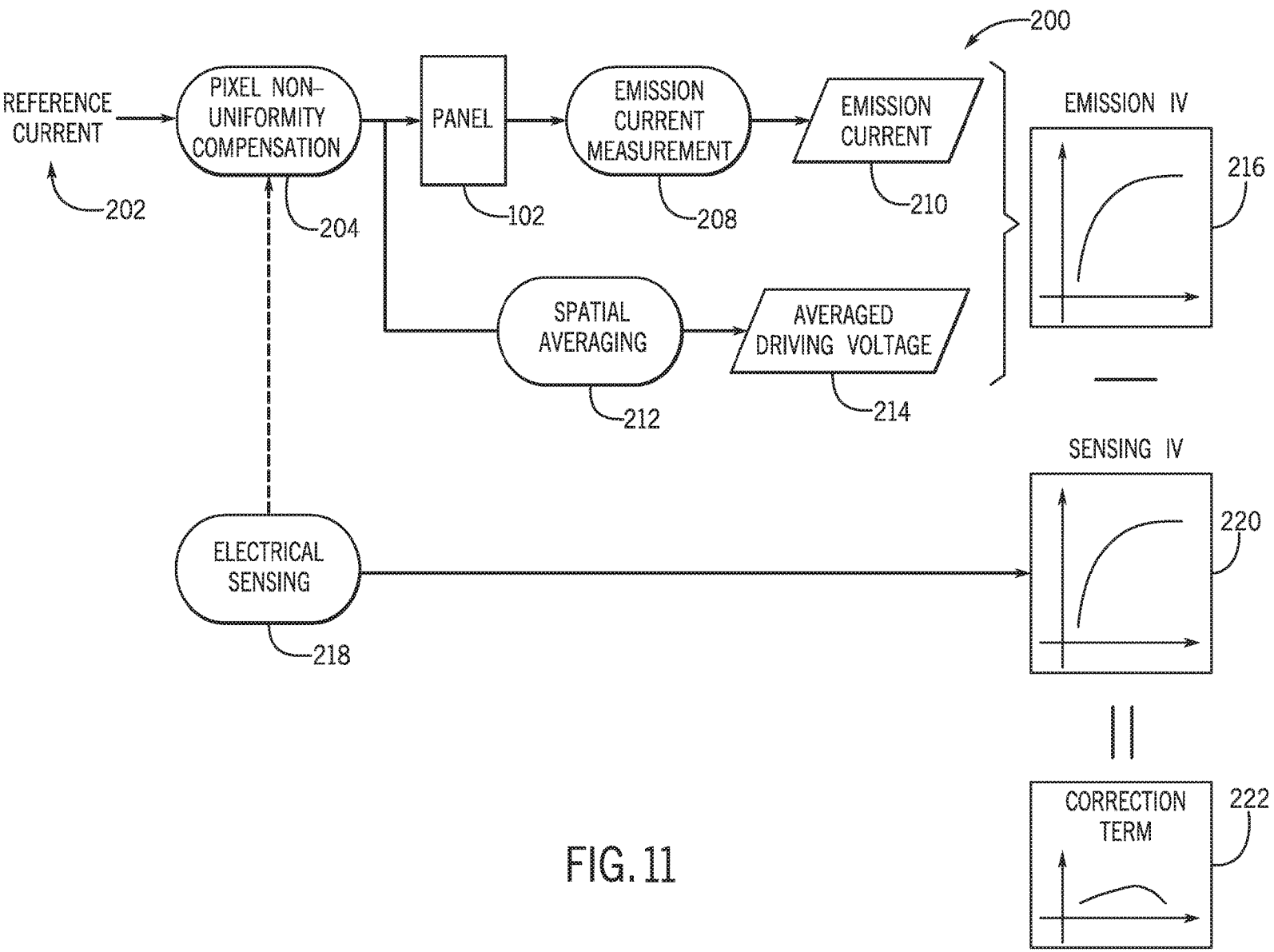
FIG. 11 is a diagram illustrating a process to implement external compensation, in accordance with an embodiment.

Diagram 200 in FIG. 11 illustrates a process for determining differences in IV between the normal and sensing conditions. In order to obtain the IV curves, a reference current 202 may be used. The reference current 202 may be adjusted using a pixel-level non-uniformity compensation 204, to prevent interference from high-frequency noise or other pixel-to-pixel variations. The compensated electrical signal may go to pixels of the pixel panel 102. The emission current from pixels in the pixel panel 102 may be measured by a process 208 to produce an emission current reading 210. That measurement may take place during calibration in a factory, and may include the use of highly sensitive low impedance current measuring instruments or through the measurement of the brightness of the pixel. The electrical signal may also go through a spatial averaging 212 of the driving voltages, to provide an averaged voltage reading 214. Based on the emission current reading 210 and the averaged voltage reading 214, an emission IV curve 216 may be generated. The sensing circuit 218 of the display panel may be used to obtain the sensing IV curve 220. As discussed above, based on a difference between the emission IV curve 216 and the sensing IV curve 220, a correction term 222 may be obtained.

The characterization described in diagram 200 may be performed in the production of the electronic device 10 (e.g., during manufacturing, testing, or quality control), and the identified correction term 222 may be stored in the compensation circuitry or in a memory of the electronic device 10. The calibration and generation of the correction term 222 may be generated automatically by a calibration electronic device. Such calibration electronic device may include, or be coupled to, low-impedance current sensors, brightness sensors, or any other instrument capable of measuring currents or brightness without affecting any biasing voltage in the pixel circuitry. In some electronic devices 10, the calibration device may be included, and may be configured to perform the characterization process described in diagram 200 periodically (e.g., after a time period established by a wall clock, after a number of initializations, after a number of hours of uptime of the device), to recalculate the correction term 222 and incorporate variations resulting from regular usage of the display after the initial programming of the compensation circuitry.

The process illustrated described by diagram 200 employs a spatial averaging 212. As a result, the correction term 222 described may be specific to a region of the display panel. For example, a display panel having 1920×1080 pixels may be divided into 200 regions in a 20×10 grid with 96×108 pixels in each region, and the compensation circuitry may store one correction term 222 for each region. In some embodiments, the process illustrated by diagram 200 may bypass the spatial averaging 212, and the compensation circuitry may perform compensation on an individual pixel basis.

Figure 12:
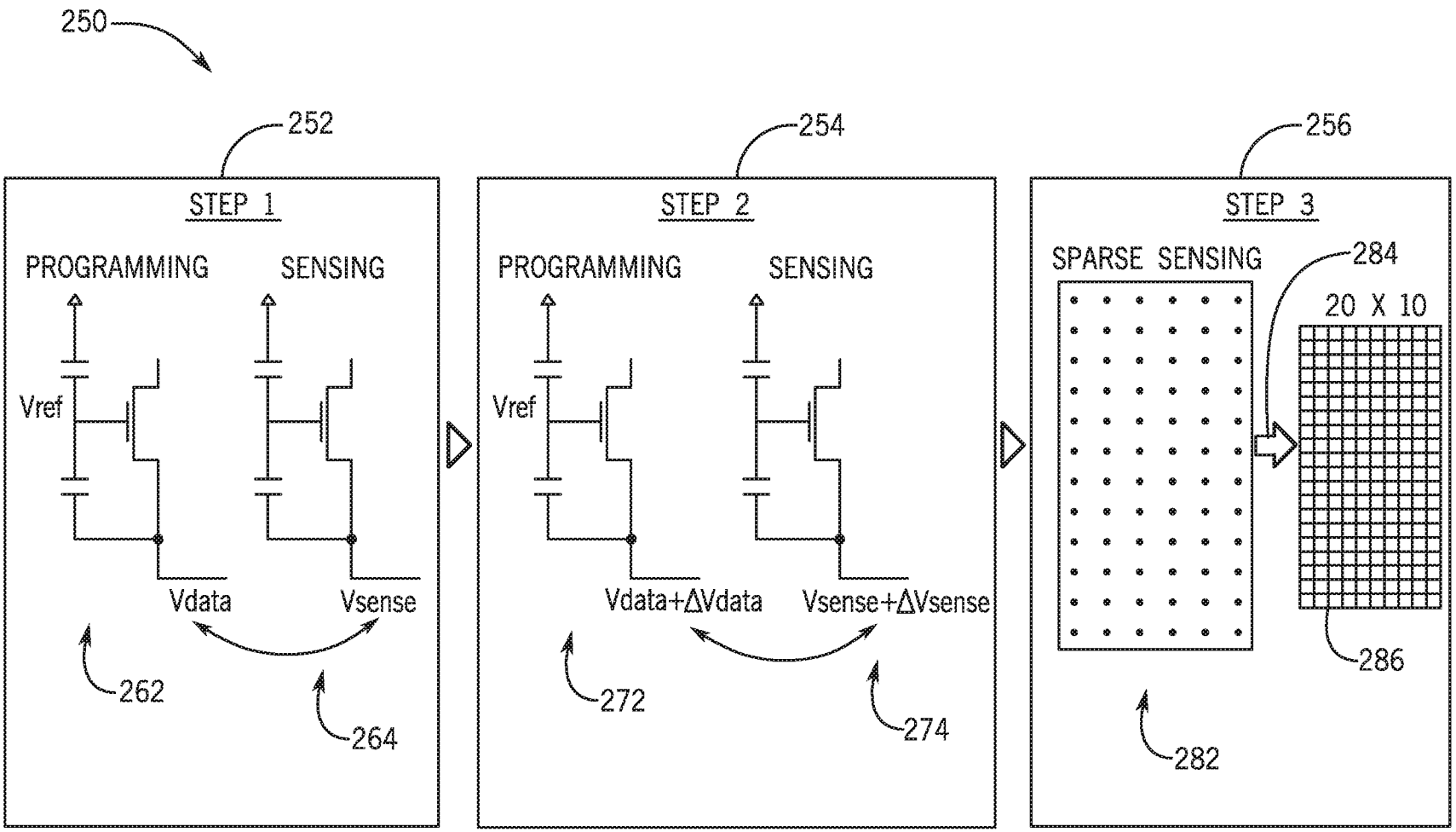
FIG. 12 is a diagram illustrating a process to identify a correction factor for external compensation, in accordance with an embodiment.

FIG. 12 further details the calculation of the correction term 222. As shown in expression (4) above, the correction factor may be determined by an application of a discrete differentiation. That is, by applying differentiation or a discrete differentiation of the expression (4), a compensation ratio may be obtained as:

$$C_{ratio}=\frac{\Delta V_{data}}{\Delta V_{sense}}. \tag{5}$$

In the above expression, the discrete differences $\Delta V_{data}$ (i.e., differential data voltage) and $\Delta V_{sense}$ (i.e., differential sense voltage) are calculated with respect to a baseline data voltage $V_{data}$ and baseline sense voltage $V_{sense}$ that provides a matching current $I_S$ and in which $\Delta V_{data}$ and $\Delta V_{sense}$ lead to a similar change in current. The diagram on FIG. 12 illustrates a 3-step process 250 for characterizing the correction factor based on this principle. The process 250 may have a first stage 252 in which a baseline data voltage is determined, a second stage 254 in which discrete differences are determined, and a third stage 256 in which the panel may be programmed.

In the first stage 252, the pixel circuitry may be set to a baseline iteratively. The iterations loop between steps 262 and 264. A $V_{sense}$ voltage may be set in step 264. With the set $V_{sense}$ voltage set, a search for $V_{data}$ voltage that reaches a target current, in step 262, may be applied. The search for $V_{data}$ may proceed by testing voltages over a range of values. In the second stage 254, the pixel circuitry may iterate between steps 272 and 274. In step 274, a $V_{sense}+\Delta V_{sense}$ voltage may be set in step 274. In steps 272, a search for a $\Delta V_{data}$ that causes $V_{data}+\Delta V_{data}$ the pixel to provide the target current, may be performed. The correction factor may be then calculated by the expression (5), shown above. The search for the $\Delta V_{data}$ may be proceed by testing voltages over a range of values. Stages 252 and 254 may be repeated for multiple baselines of $V_{sense}$ and $V_{data}$.

Stages 252 and 254 may be performed with every pixel of the display panel or may implemented over a sparse subset of the pixels. The third stage 256 illustrates a sparse implementation. The sampling 282 illustrates a division that may be used for sparse calibration. For example, in a panel having 1920×1080 pixels, the display may be divided into 200 regions in a 20×10 grid with 96×108 pixels in each region, and stages 252 and 254 may be performed in one or few pixels for each region. The correction factor for the tested pixels in each region may be then averaged (process 284) to produce a grid 286 of correction factors. The correction factor for region of the grid 286 may be applied to all pixels of the region. The data for each region of the grid may be stored in the compensation circuitry, as discussed above.

Figure 13:
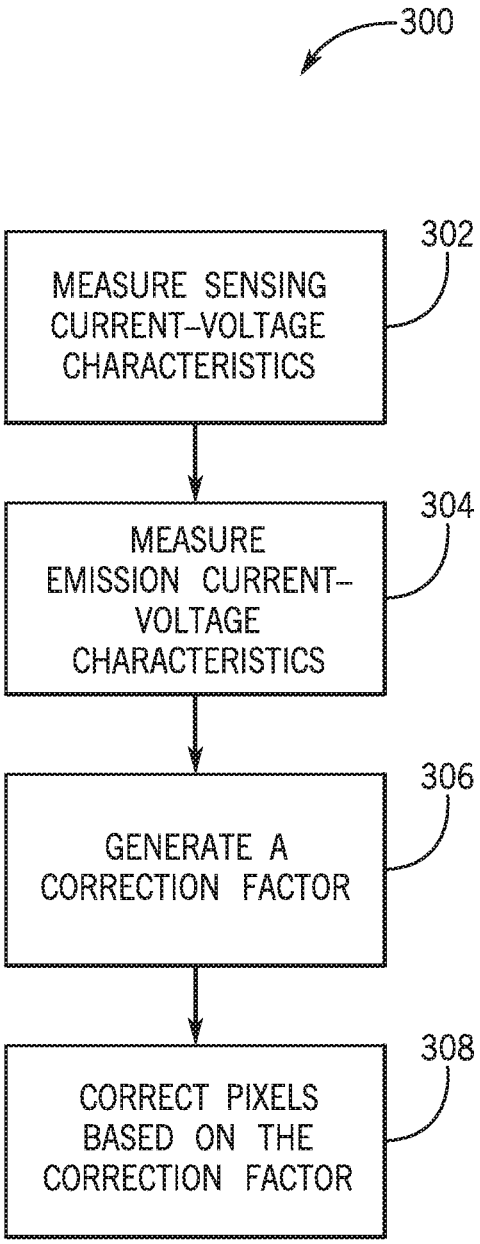
FIG. 13 is a flow chart of a method to implement external compensation, in accordance with an embodiment.

FIG. 13 illustrates a method 300 for compensation for displays using the sensing and emission differences discussed above. Process 302 includes the measurement of the current-voltage characteristic of the pixels while the pixel is being sensed. Process 304 includes the measurement of the current-voltage characteristics of the pixels while the pixel is not being sensed. Process 302 and 304 may take place simultaneously or sequentially by any of the methods described above. Moreover, the measurements in processes 302 and 304 may be carried on every pixel of the display, or in a subset of pixels of the display, which may be determined by sampling. For example, in situations where the low-spatial artifacts is of concern may cause artifacts, the measurements may be performed on a sparse sample of the pixels of the display.

In process 306, a correction factor may be determined based on the data obtained in processes 302 and 304. It should be noted that the correction factor determination in process 306 may be integral to the processes 302 and 304. For example, the calibration process may simultaneously perform processes 302 and 304 and may determine a correction factor using process 306 simultaneously, without long-term storage of the intermediate values. As discussed above, the correction factor calculated in process 306 may be used to provide improved images in process 308. Process 308 may include programming the compensation circuitry using the correction factor calculated. As discussed above, the compensation circuitry may employ the correction factor for each individual pixel or for all pixels in a region. The distribution of pixels may be based on a spatial location, as discussed above.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . " it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. An electronic device, comprising:

a pixel panel comprising a plurality of pixels;

sensing circuitry configured to:

electrically couple to at least one pixel of the plurality of pixels to measure a current of the at least one pixel of the plurality of pixels, wherein electrically coupling the sensing circuitry to the at least one pixel causes a calibration device electrically coupled to the at least one pixel to receive a first output voltage from the at least one pixel; and electrically uncouple from the at least one pixel, wherein electrically uncoupling the sensing circuitry from the at least one pixel causes the calibration device to receive a second output voltage from the at least one pixel; and compensation circuitry coupled to the sensing circuitry and to the plurality of pixels, wherein the compensation circuitry is configured to:

receive an image signal corresponding to the at least one pixel from processing circuitry of the electronic device;

receive the measured current associated with the at least one pixel from the sensing circuitry;

receive a correction factor determined by the calibration device based on the first output voltage and the second output voltage; and in response to the sensing circuitry electrically coupling to the at least one pixel:

generate a compensated image signal for the at least one pixel based at least in part on the image signal, the measured current, and the correction factor to compensate for a voltage difference at the at least one pixel between the first output voltage and the second output voltage; and provide the compensated image signal for the at least one pixel.

2. The electronic device of claim 1, wherein the compensation circuitry comprises memory storing the correction factor.

3. The electronic device of claim 1, wherein the pixel panel comprises a plurality of regions, each region comprising a set of pixels, and wherein image signal corresponding to all pixels of a respective region are compensated using a respective correction factor associated with the respective region.

4. The electronic device of claim 1, wherein the first output voltage and the second output voltage are measured between a source and a gate of a transistor associated with the at least one pixel to determine a voltage difference between an input voltage and an output voltage at the at least one pixel when the sensing circuitry is electrically coupled to and electrically uncoupled from the at least one pixel.

5. The electronic device of claim 1, wherein the first output voltage is measured between a source and a gate of a transistor associated with the at least one pixel, wherein electrically coupling the sensing circuitry to the at least one pixel is characterized by the first output voltage varying directly with a difference between an input source voltage and an anode voltage of the transistor.

6. The electronic device of claim 1, wherein the second output voltage is measured between a source and a gate of a transistor associated with the at least one pixel, wherein electrically uncoupling the sensing circuitry from the at least one pixel is characterized by the second output voltage varying directly with a difference between an input data voltage and an anode voltage of the transistor.

7. The electronic device of claim 1, wherein electrically coupling the sensing circuitry to the at least one pixel results in an increase in the current to the at least one pixel compared to when the sensing circuitry is electrically uncoupled from the at least one pixel.

8. The electronic device of claim 7, wherein the increase in the current to the at least one pixel is non-linear.

9. A method for calibration of a pixel panel, comprising:

determining a respective first current-voltage characteristic for each respective pixel of a subset of pixels of a set of pixels of the pixel panel based at least in part on measuring a first output voltage from each respective pixel when sensing circuitry of the pixel panel is not coupled to each respective pixel;

determining a respective second current-voltage characteristic for each respective pixel based at least in part on measuring a second output voltage from each respective pixel when the sensing circuitry is coupled to each respective pixel;

determining a respective correction factor for generating a respective compensated image signal for each respective pixel based at least in part on the respective first current-voltage characteristic and the respective second current-voltage characteristic to compensate for a voltage difference between the first output voltage and the second output voltage from each respective pixel; and storing the respective correction factor in compensation circuitry of the pixel panel.

10. The method of claim 9, wherein the subset of pixels comprise the set of pixels of the pixel panel.

11. The method of claim 9, wherein the pixel panel comprises a plurality of regions, each respective region comprises a respective at least one pixel of the subset of pixels, and wherein a correction factor for each pixel of each respective region is associated with the respective correction factor for the respective at least one pixel.

12. The method of claim 11, wherein the plurality of regions comprises at least 200 regions.

13. The method of claim 9, wherein determining the respective second current-voltage characteristic comprises providing a reference current to a first region of the pixel panel and measuring an emission current from the first region of the pixel panel.

14. The method of claim 9, wherein the pixel panel comprises a light-emitting diode (LED) panel or an organic light-emitting diode (OLED) panel.

15. The method of claim 9, wherein determining the respective correction factor comprises calculating a ratio of a differential data voltage and a differential sensing voltage based on measuring the first output voltage and the second output voltage.

16. The method of claim 9, comprising:

uncoupling the sensing circuitry from each respective pixel prior to determining the respective first current-voltage characteristic for each respective pixel; and coupling the sensing circuitry to each respective pixel prior to determining the respective second current-voltage characteristic for each respective pixel.

17. A method for compensation of brightness of a pixel panel of an electronic device, comprising:

receiving, from processing circuitry of the electronic device, an electric signal corresponding to a target current for a pixel;

receiving, from sensing circuitry of the pixel panel, a current measurement for the pixel in response to the electric signal;

receiving and storing, in compensation circuitry of the pixel panel, a correction factor based on a first output voltage when the sensing circuitry is configured to sense the current measurement for the pixel and a second output voltage when the sensing circuitry is configured not to sense the current measurement for the pixel to compensate for a voltage difference at the pixel between the first output voltage and the second output voltage;

generating, in the compensation circuitry of the pixel panel, a compensated signal for the pixel based at least in part on the electric signal, a difference between the target current and the current measurement, and the correction factor; and providing the compensated signal to the pixel.

18. The method of claim 17, wherein generating the correction factor comprises applying a function of the current measurement.

19. The method of claim 17, wherein generating and storing the correction factor comprises:

setting a baseline sense voltage in the pixel;

searching a baseline data voltage in the pixel that provides a first current associated with the baseline sense voltage;

adding differential sense voltage to the baseline sense voltage in the pixel;

searching a differential data voltage in the pixel, wherein the differential data voltage is configured to provide the first current associated with the combination of the differential sense voltage and the baseline sense voltage; and determining the correction factor based at least in part on a ratio using the differential data voltage and the differential sense voltage.

20. The method of claim 17, wherein generating the compensated signal for the pixel comprises compensating for a change in a source voltage of a transistor of the pixel caused by causing the sensing circuitry to sense the current measurement for the pixel.

* * * * *